US006199543B1

(12) United States Patent
Bedkowski

(10) Patent No.: US 6,199,543 B1
(45) Date of Patent: Mar. 13, 2001

(54) BREATHER BAFFLE

(75) Inventor: Maciej Bedkowski, Peterborough (GB)

(73) Assignee: Perkins Engines Company Limited, Peterborough (GB)

( * ) Notice: Subject to any disclaimer, the term of this patent is extended or adjusted under 35 U.S.C. 154(b) by 0 days.

(21) Appl. No.: 09/493,535

(22) Filed: Jan. 28, 2000

(30) Foreign Application Priority Data

Feb. 18, 1999 (GB) ..... 9903611

(51) Int. Cl.[7] ..... F02M 25/06
(52) U.S. Cl. ..... 123/572; 123/573
(58) Field of Search ..... 123/572, 573, 123/574, 41.86

(56) References Cited

U.S. PATENT DOCUMENTS

| | | | | |
|---|---|---|---|---|
| 4,341,540 | | 7/1982 | Howerin . | |
| 4,459,966 | * | 7/1984 | Sakano et al. | 123/573 |
| 4,597,372 | * | 7/1986 | Furukawa | 123/572 |
| 4,768,493 | * | 9/1988 | Ohtaka et al. | 123/573 |
| 5,243,950 | * | 9/1993 | Dalupan | 123/572 |
| 5,277,154 | * | 1/1994 | McDowell | 123/573 |
| 5,471,966 | | 12/1995 | Feuling . | |

FOREIGN PATENT DOCUMENTS

| | | |
|---|---|---|
| 472 634 | 3/1929 | (DE) . |
| 3727 143 A1 | 2/1989 | (DE) . |
| 195 20 533 A1 | 3/1996 | (DE) . |

* cited by examiner

*Primary Examiner*—Marguerite McMahon
(74) *Attorney, Agent, or Firm*—Alan J. Hickman

(57) ABSTRACT

A baffle for fitment over breather gas inlet of an internal combustion engine breather system to limit the ingress of oil droplets has a baffle plate at a first end, a second end connectable to a breather gas inlet, and a gas conduit extending between the ends, open at the second end and closed at the first end by the baffle plate, and having a perforated wall.

14 Claims, 3 Drawing Sheets

BREATHER BAFFLE

BACKGROUND OF THE INVENTION

The present invention relates to an oil deflector apparatus (a baffle) for use in apparatus for cleaning internal combustion engine crankcase breather (blow-by) gas, an internal combustion engine including such apparatus, and a method of use of such apparatus.

During the compression and power strokes in an internal combustion engine, the difference in gas pressures above and below a piston is sufficient to cause leakage (blow-by) of gas past the piston into the engine crankcase. The resulting increase in pressure within the crankcase can force oil past by the engine oil seals and this pressure may also damage the seals and hence lead to further leakage of oil.

To diminish the damaging effects of blow-by it is normal to relieve the crankcase pressure either by venting the breather gas to atmosphere via an open breather or by connecting the crankcase to the engine air intake system whereby breather gas is conveyed to the engine combustion chamber via the engine air inlet system and under the control of a pressure regulating means. This latter system constitutes a closed-circuit breather system.

It is desirable to include, in breather systems, means to retrieve oil contained in breather gas and return this to the engine lubricating oil system for re-use. Otherwise the carry-over of oil will lead to pollution and, in a closed-circuit system, to fouling of turbocharger compressor vanes, engine poppet valves and other components in contact with inlet air.

As well as leading to contamination and emission problems, the carry-over of oil in breather gas will reduce the volume of oil available for the lubricating and cooling requirements of the engine. It is desirable to minimised oil carry-over, and an oil/air separator is therefore included in most closed-circuit breather systems.

A further problem with oil carry-over in the closed-circuit breather system of an engine, especially of the diesel type, is that the oil can fuel the engine and lead to an unintentional and possibly severe increase in engine speed known as 'run-away'.

The run-away problem may be exacerbated where the engine is operated at high gradients (angles of inclination), especially where conditions of abuse prevail, and in particular where the designed maximum oil level in the sump has been exceeded, where the intake air filter is dirty and/or where blow-by levels are high due to engine wear. A particular problem may arise in severe abuse conditions, at severe inclinations, in that the surface of the volume of oil within an engine sump can become closer to the breather gas connection. The tendency of this volume of oil to simultaneously become agitated, by for example the partly submerged and rotating crankshaft, can result in oil being splashed and sucked up into a breather inlet and hence translocated to the breather separator. This can be a particular problem in situations where, as might be desirable for other reasons, the breather gas inlet is already located in a relatively lower position within the engine, for instance in the engine crankcase.

Under these abuse conditions, even where a conventional separator is provided the breather system may take up more oil than the separator can handle and oil can be drawn into the engine air intake system and hence to the combustion chamber where it can fuel the engine and lead to run-away.

OBJECTS AND SUMMARY OF THE INVENTION

It is an object of the present invention to provide a baffle means for fitment to a breather gas inlet of an apparatus for cleaning internal combustion engine breather which limits the ingress of oil into the breather gas apparatus, in particular for engines operating at high gradients.

It is further object of the present invention to provide an apparatus for separating oil from breather gas in an internal combustion engine, in particular an engine operating at high gradients.

It is a further object of the present invention to provide a method of separating oil from breather gas in an internal combustion engine in particular an engine operating at high gradients.

According to a first aspect of the present invention an oil deflector apparatus (baffle) for fitment over breather gas inlet means of an internal combustion engine breather system to limit the ingress of oil droplets comprises:

- a baffle plate disposed at a first end, a second end connectable to a breather gas inlet means, and a gas conduit extending between said ends being open at the second end and closed at the first end by the baffle plate and having a perforated wall.

The gas conduit has divergent walls such that the cross-sectional area of the conduit increases as the conduit extends from said second end towards said first end.

The baffle plate may be generally planar, and disposed to lie in use in an orientation generally perpendicular to the breather gas flow into the inlet. The plate may be of such a size as to extend outwardly beyond the perimeter of the conduit at the second end. The plate may have a D-shaped face.

The baffle is particularly effective in limiting the amount of oil splash sucked into breather gas inlet means located lower in the engine, for example within the crank case portion.

Although a simple perforated baffle is effective in reducing the likelihood of oil droplets being sucked into the breather inlet, particularly if in suitable orientation, the configuration and orientation of the baffle components is of importance in optimising effectiveness.

Preferably the baffle comprises a plurality of perforated baffle elements extending between the first and second ends so as to be disposed around a breather gas flow into the inlet in use.

Preferably the baffle elements comprise a plurality of substantially planar perforated baffle faces formed into a conduit by means of perforated or un-perforated intermediate portions. In a preferred arrangement, the baffle is provided with three such baffle faces, so as to produce a baffle conduit having substantially triangular cross-section.

According to a further aspect of the present invention, a breather system for an internal combustion engine comprising breather gas inlet means to receive breather gas from within an engine casing, and fluidly connected via breather gas conduit means to a separator capable of separating oil from suspension within the breather gas, has baffle means as above described fitted in position over the breather gas inlet means to limit the ingress of oil droplets.

Preferably, the breather gas inlet means are disposed to open away from the vertical, for example generally horizontally, with respect to an engine in a nominally horizontal orientation. Where the breather gas inlet means are so arranged, a baffle in which the baffle elements comprise a plurality of substantially planar baffle faces formed into a conduit by means of intermediate portions as above described is particularly preferred.

In such an arrangement, the intermediate portions comprise areas of relatively high curvature, or even sharp corners. The baffle is particularly effective where the breather arrangement is such that the breather gas inlet means open nominally horizontally into the volume defined by an engine casing when the engine is in a nominally horizontal disposition, and the baffle is arranged to be fitted onto the breather gas inlet means to be so disposed that an intermediate portion is nominally lowermost with the engine in such an horizontal orientation. Most preferably, a baffle comprising three baffle faces and having substantially triangular cross-section, as above described, is fitted to the inlet means and is so disposed that a baffle face is nominally uppermost in use with the engine in a nominally horizontal orientation. In this orientation, the holes in the baffle are presented at an angle to the prevailing direction of oil droplets impinging on the baffle.

A particular advantage of the use of the baffle in accordance with the present invention is that it permits consideration of use of breather inlets located in lower positions on the engine within the crank case volume, rather than within the top cover. Such locations may not generally be practicable in prior art systems, since in harsh considerations of operation where lower positions are used for the breather gas inlet means, lubricating oil is more likely to be splashed up into the vicinity of the inlet means, so that large oil droplets may be sucked in and transferred to the separator and oil levels within the separator may rise to levels beyond its capacity. Use of the baffle in accordance with the invention mitigates this effect.

As a result, in a particularly preferred arrangement, the internal combustion engine breather system further comprises: a crankcase defining a lower, crankcase volume and a top cover defining an upper volume; breather gas inlet means to receive breather gas from one or more locations within the crankcase volume; and breather gas conduit means fluidly connecting said breather gas inlet means to a separator capable of separating oil from suspension within the breather gas.

Conventionally, oil drain means to remove separated oil from the separator and gas outlet conduit means to remove the cleaned gaseous product from the separator are also provided.

Conventional breather devices generally have breather inlet means positioned to accept breather gas from the volume within the engine casing defined by the top cover. With a baffle fitted in accordance with the present invention, at least some of the breather gas may be taken from the crankcase portion of the engine. It has been found that, particularly where engines are operating at severe inclinations, gas taken from this part of the engine casing is likely to have a lower oil content in suspension within the breather gas than is the case for gas taken from locations in the upper part of the casing defined by the top cover. This is particularly the case where the breather gas intake means are located in a less active area of the engine, such as might be provided by a housing to accept a fuel injection pump or a timing case portion, each of which may conveniently be located in the forward part of the crankcase.

The engine air intake means may be in the form of a turbocharger intake, or in the form of a conventional air inlet manifold.

Passageways may be provided within an engine cylinder head to provide a fluid connection between the upper and lower volumes within the engine casing.

Preferably, the lower portion of the crankcase defines a lubricating oil sump, and the forward part of the crankcase comprises a timing case for enclosing drive means, and a fuel injector pump housing, the volume defined by the timing case being fluidly connected to the volume defined by the fuel injection pump housing and substantially open to the sump at a lower end and the inlet means opening into the fuel injector pump housing volume. In this arrangement, the volume defined by the timing case is fluidly connected via suitable conduits within the cylinder head to the upper volume defined by the top cover.

The oil drain means conveniently returns oil to the sump.

The invention is particularly suited to a closed breather system, in which the gas outlet conduit means fluidly connect with, and convey the cleaned gaseous product of the separator to the engine air intake system.

To assist free draining of separated oil at high operating inclinations, the separator may be located in a position as high on the engine as practicable, and the oil drain means may include non-return valve means to prevent draining oil being forced back up the oil drain means by gas pressure variation.

The invention also comprises an internal combustion engine incorporating the above apparatus.

The invention also comprises a method for cleaning internal combustion engine crankcase breather gas, which method comprises the fitment of a baffle as above described to the breather gas inlet of a breather system on an internal combustion engine, or the use of a breather system as above described.

BRIEF DESCRIPTION OF THE DRAWINGS

By way of example, the invention will be described with reference to the accompanying drawings, of which.

DESCRIPTION OF THE PREFERRED EMBODIMENTS

Figure 1A:
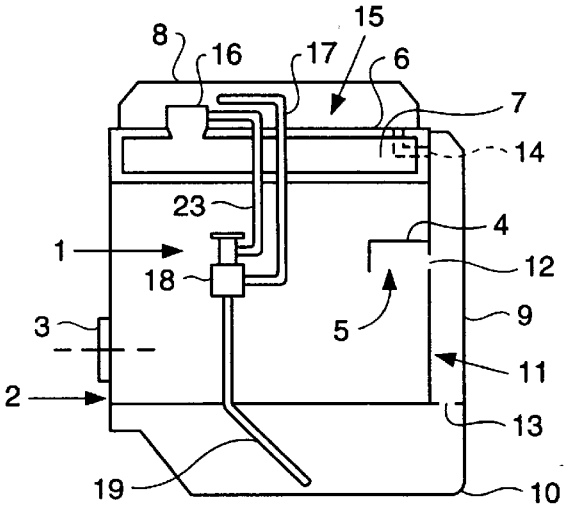
Fig. 1a PRIOR ART
FIG. 1A is a schematic side view of a prior art internal combustion engine.

Referring to the drawings, FIG. 1A shows a known engine including a cylinder block 1 of which a lower crankcase portion 2 carries a crankshaft 3 and an upper forward part includes a housing 4 defining a volume 5 to accept a fuel injection pump (not shown). The cylinder block is covered by a cylinder head 6 which, in turn, supports an engine air intake manifold 7 including an air intake 16 and a top cover 8. A camshaft (not shown) is contained substantially within a longitudinal chamber (not shown) in an upper part of the cylinder block 1.

Affixed to a front end of the cylinder block is a timing case 9 enclosing drive means (not shown) from the crankshaft to the camshaft and to a fuel injection pump, and affixed to the crankcase portion of the cylinder block is a lubricating oil sump 10. A volume 11 defined by the timing case 9 is fluidly connected to the volume 5 defined by the fuel injection pump housing via a passageway 12 and is substantially open to the sump at a lower end through the aperture 13. The volume defined by the timing case is also fluidly connected via a passage 14 to a volume 15 defined by the top cover 8.

The prior art engine of FIG. 1A is conventionally fitted with a breather system wherein breather gas is taken from a connection in the top cover via a conduit 17 to a gas/oil separator 18. The retrieved oil is returned to the sump 10 via an oil drain pipe 19, and a conduit 23 conveys cleaned gas from the separator to the air intake manifold. However, the gas taken from this point may carry a high a volume of oil detrimental to efficient gas/oil separation, even in nominally horizontal operation of the engine. Therefore the invention provides for alternative arrangements which offer the potential to reduce the oil content present in the breather gas when it reaches the separator.

Figure 1B:
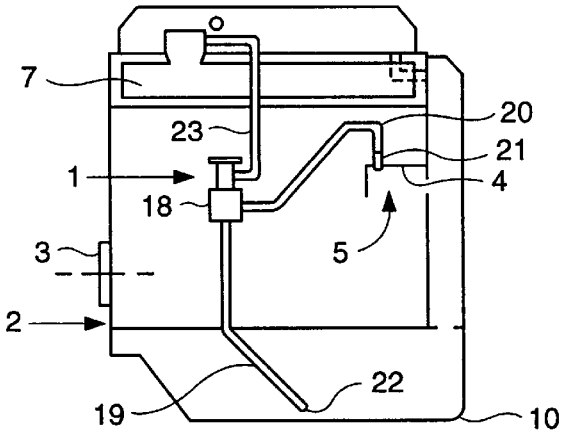
FIG. 1B through to FIG. 1F are schematic side views of an internal combustion engine depicting the effect of fitment of an oil deflector apparatus or baffle in accordance with the present invention.

Depicted in FIG. 1B is an improved means for separating oil from breather gas and directing the salvaged oil back into the sump. Many elements are common with the prior art arrangement of FIG. 1A, and where applicable like reference signs are used for like components.

A conventional gas/oil separator 18 is mounted in a first position on the cylinder block 1 approximately 50 mm below the intake manifold 7. A first breather gas inlet in the separator 18 is fluidly connected via a conduit 20 and a connection 21 to the volume 5 defined by the fuel injection pump housing 4. Test results have shown that the breather gas contained within this volume is already relatively low in oil content when compared with, for example, the volume defined by the top cover from which the breather gas inlet draws in the prior art arrangement of FIG. 1A. This configuration therefore exhibits improved performance for a given separator, and reduces the tendency for separator capacity to be exceeded under harsher operating conditions.

An oil drain pipe 19 from the separator is connected to a connection 22 in a low, nominally central, position in the sump 10 to keep the outlet end of the pipe submerged in oil to ensure functioning of the separator under extremes of engine inclination. A conduit 23 conveys cleaned gas from the separator to the engine air intake manifold 7 (or turbocharger air intake as the case may be) for combustion by the engine.

Engines were subjected to tests of the arrangement shown in FIG. 1B followed by tests of subsequent arrangements to be described hereinbelow. The tests were designed to establish the maximum acceptable gradeability as limited by the effectiveness of the breather apparatus and the abuse conditions that the engine might suffer in practice.

For the tests, the abuse conditions comprised overfilling the sump by one liter of oil above the designed maximum of 8 L for this known engine (representing operator error), increasing blow-by levels from a normal 0,6 L/s to a high 1,5 L/s (representing a worn engine) and increasing air induction depression from a normal 5 kPa to a high 8 kPa (representing a dirty air filter).

With the breather arrangement shown in FIG. 1B, oil carry-over measured using Mann & Hummel absolute filters was an acceptable 2 g/hour with the engine operated in a nominally horizontal mode. Maximum gradeabilities before the engine would encounter a level of oil carry-over that might lead to the potential for engine run-away were then measured for the engine in Front End Down (FED), Front End Up (FEU), Left Hand Down (LHD) and Right Hand Down (RHD) inclinations. For test engines fitted with the apparatus of FIG. 1B, the maximum allowable gradeabilities under normal and abuse conditions were found to be as shown in Table 1.

TABLE 1

| Inclination | Normal | Abuse |
|---|---|---|
| FED | 20° | 12° |
| FEU | 45° | 37° |
| LHD | 45° | 35° |
| RHD | 40° | 35° |

The breather arrangement of FIG. 1B was shown to offer some enhanced performance in reducing carry-over when compared with prior art systems as shown in FIG. 1A, since the oil content in breather gas reaching the separator was reduced. Although offering improved effectiveness the arrangement still exhibited limited capability in coping with the oil leaving the fuel injection pump housing during severe FED inclinations. Oil carry-over during FED inclination tends to be particularly severe because, in this attitude, the oil which would be carried within the sump during generally horizontal engine operation can enter the timing case and get thrown upwardly by crankshaft-driven rotating engine components (not shown) located within the timing case.

The benefit of a larger drain pipe bore to cope with oil discharge from the separator to the sump during FED inclinations was identified. In the embodiment of FIG. 1B as tested above, conventional calculations led to the use of a 3 mm bore. However, when drain pipes having a larger bore were tried, a bore of 10 mm was surprisingly found to increase the acceptable FED inclination to 15°.

A further contributory factor to the inadequate oil drainage in harsh gradient conditions is oscillating gas pressure within the crankcase. In the foregoing tests although the lower end of the oil drain pipe remained immersed in oil in the sump, a very high oscillating crankcase pressure was found to occur, which opposed free draining of the oil.

Throughout testing a high oscillating pressure of 100 to 400 mm $H_2O$ was recorded, this tending to drive oil from the fuel injection pump housing particularly during FED inclinations. Increasing the bore of the connection in the fuel injection pump housing above 10 mm does not appear to effect further reduction in the crankcase pressure.

Figure 1C:
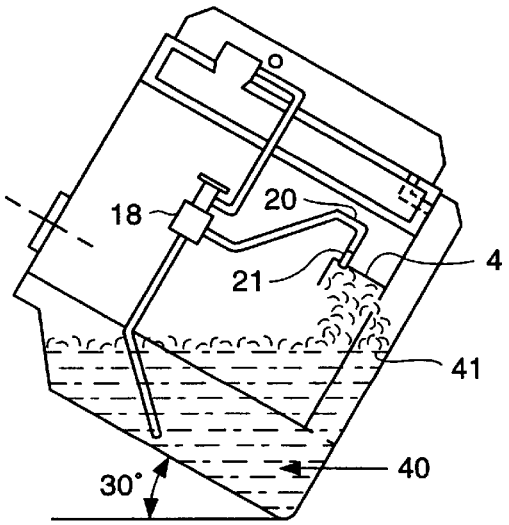
Figure 1D:
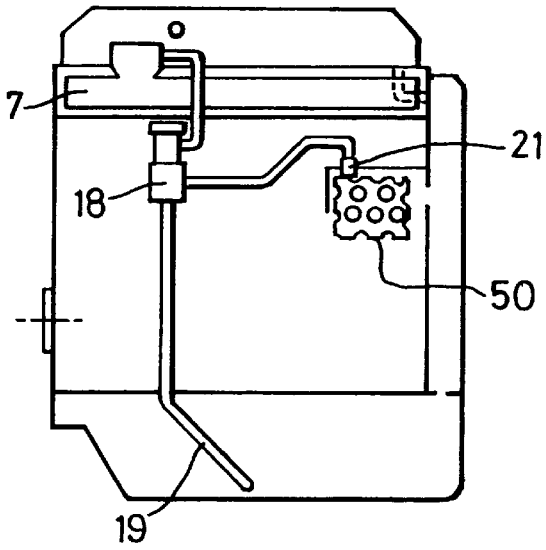

A further limitation may be identified, as shown in FIG. 1C, in that with the engine at severe FED inclinations at which a surface 41 of the volume of oil 40 within the engine sump and crankcase became close to the breather gas connection 21 in the fuel injection pump housing 4. Since this volume of oil under such conditions simultaneously may be caused by, for example, the partly submerged and rotating crankshaft, to become turbulent, oil may be splashed and 'sucked up' into the breather pipe 20 and hence translocated to the breather separator 18 which may not be able to handle the resultant preponderance of oil.

Fitment of a baffle may mitigate the problem to some extent. A perforated baffle 50 was fitted to the experimental engine of FIG. 1B. This was found to increase FED gradiability to some extent to 27,5°.

The crankcase pressure still exhibited a degree of undesirable oscillation, between 60 and 300 mm $H_2O$. It appears that pressure increase is proportional to the angle of engine inclination. The greater the inclination, the higher the crankcase pressure and hence the higher the impediment to oil drainage from the separator to the sump.

This may be due in part to oil drain holes from upper regions of the engine being of insufficient cross-sectional size to allow free passage of both blow-by gas and lubricating oil during inclination.

Figure 1E:
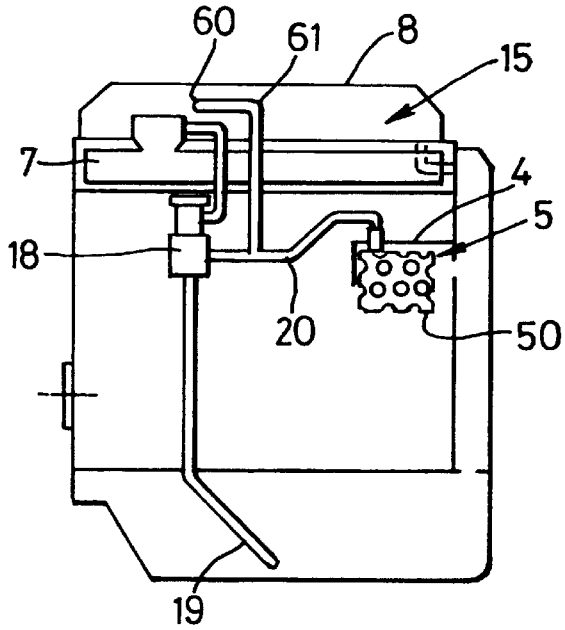
Figure 1F:
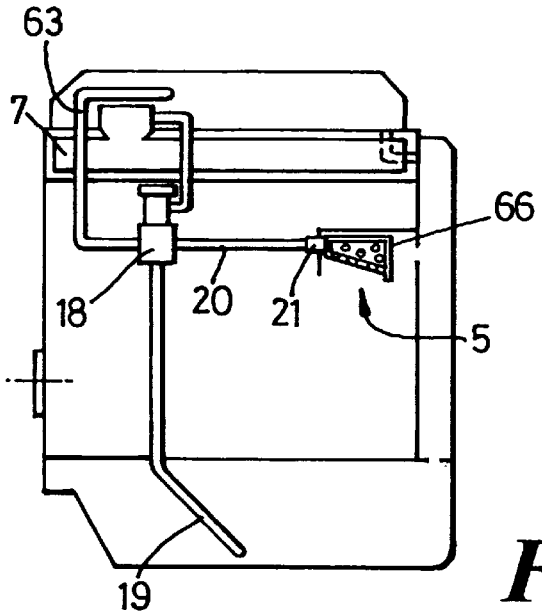

FIGS. 1E and 1F illustrate modifications of the apparatus of FIG. 1B so as to increase engine gradiability.

In FIG. 1E, a breather outlet 60 in the top cover 8 is fluidly connected via an upper breather pipe 61 via the separator pipe 20 to the volume 5 defined by the fuel injector pump housing 4. This provides a means of reducing the crankcase pressure in the vicinity of the breather outlet connection in the fuel injection pump housing in order to reduce oil carry-over into the breather system.

It has been shown that arrangements such as FIG. 1A which take breather gases for cleaning solely from the volume defined by the top cover are undesirable due to the high gas/oil activity in that region and the improved performance obtained by taking breather gases from the volume 5. However, the gas pressure within the volume 15 defined by the top cover is likely to be lower than that within the crankcase since the limited size available for the passages connecting crankcase and top cover via the timing case and cylinder head may provide only partial pressure equalisation. The arrangement of FIGS. 1E and 1F exploit this pressure differential.

An optimum bore diameter of 12 mm was identified for the upper breather pipe 61 in the example engine, this giving a considerable increase in FED gradiability to 35°. Importantly, during inclination of the engine, crankcase pressure remained at a low oscillating level of 40 to 60 mm $H_2O$ at which breather gases could leave the fuel injection pump housing and the top cover at a lower velocity than before, thus carrying less oil. Further, the lower crankcase pressure has a correspondingly reduced deleterious effect on the engine oil seals and there is thus a reduced risk of oil leakage from the engine. It should be noted that removal of the baffle reduced FED gradiability to 22,5°. Hence it may be seen that the upper pipe and the baffle 50 each separately improved gradiability but the combination of both apparatus produced synergistic benefits.

With the incorporation of the disclosed upper pipe apparatus and the baffle apparatus as illustrated in FIG. 1E, oil separation in the test engine was less than 1 g/hour up to 75% engine load and exceeded 2 g/hour only in full load/high speed conditions. The measured allowable gradiability of the engine type under test, ie. before the threat of run-away and in the defined abuse conditions, is summarised in Table 2.

TABLE 2

| Inclination | Original Apparatus | With Upper Pipe | With Baffle | With Upper Pipe and Baffle |
|---|---|---|---|---|
| FED | 12° | 22,5° | 27,5° | 35° |
| FEU | 37° | 35° | 35° | 35° |
| LHD | 35° | 35° | 35° | 35° |
| RHD | 35° | 35° | 35° | 35° |

FIG. 1F illustrates an alternative two-pipe arrangement. To diminish disturbance of breather gas flowing through the pipe 20 from the volume 5 defined by the fuel injection pump housing to the separator 18 and for convenience in production engine assembly, an upper breather pipe 63 is arranged to enter a second inlet port in the separator, rather than to connect with the pipe between the fuel injection pump housing and separator. Further, the breather gas connection 21 in the fuel injection pump housing is moved from an upper position to a nominally horizontal position and a modified baffle 66 is provided as will be described in detail below. In the experiment engine FED gradiability remained at 35° following these changes.

It can be seen in both FIG. 1E and FIG. 1F that the separator 18 is disposed in a position as high on the engine as practicable, closely adjacent to and just below the engine air intake manifold 7. This alternative position of the separator improves the FED gradiability in particular by an appreciable amount, by reducing the likelihood that the separator will become swamped during operation of the engine at severe inclinations. Non return valves (not shown) may be fitted to the oil drain pipe 19 as a means of preventing crank case pressure oscillations from hindering oil drainage from the separator. Such modification is found to provide some enhancement of performance with the engine in the horizontal position, but can be of limited value when the engine is severely inclined in some attitudes, since oil from the sump 10 may then fill the drain pipes up to the non return valve height and prevent them opening.

FIG. 1F illustrates an improved baffle 66 in accordance with the invention fitted inside the fuel injection pump housing, comprising a composite multi-part assembly. This is shown in more detail in FIGS. 2 and 3. The modified baffle design of FIGS. 1F, 2 and 3 was found to be smaller but the intricacies of the design are more crucial.

Figure 2:
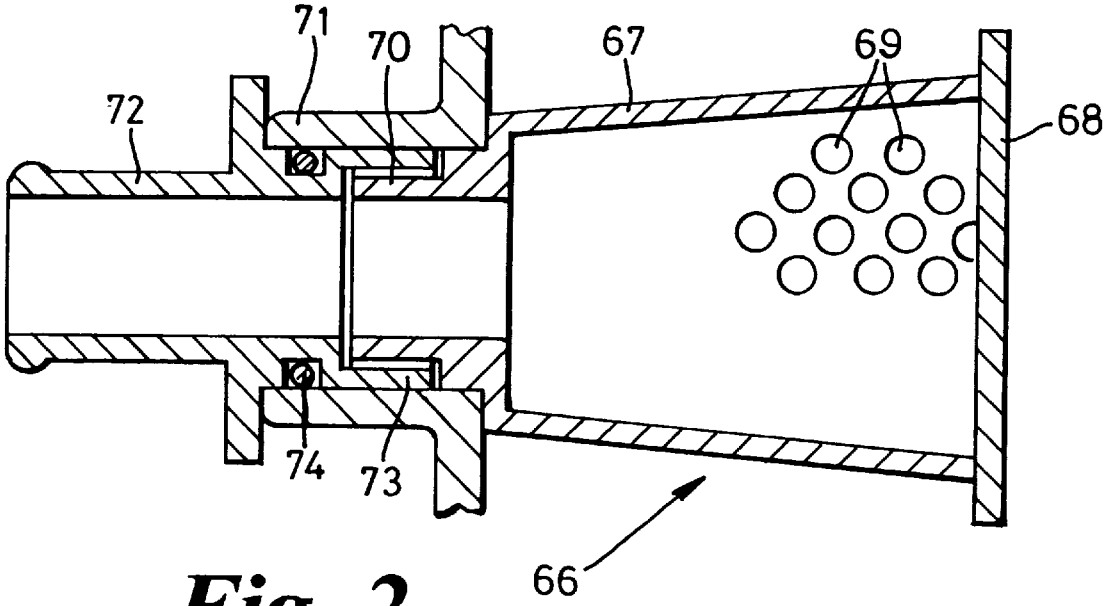
FIG. 2 is a schematic cross-sectional view through an oil deflector apparatus or baffle assembled to a fuel injection pump housing of a diesel engine.
Figure 3:
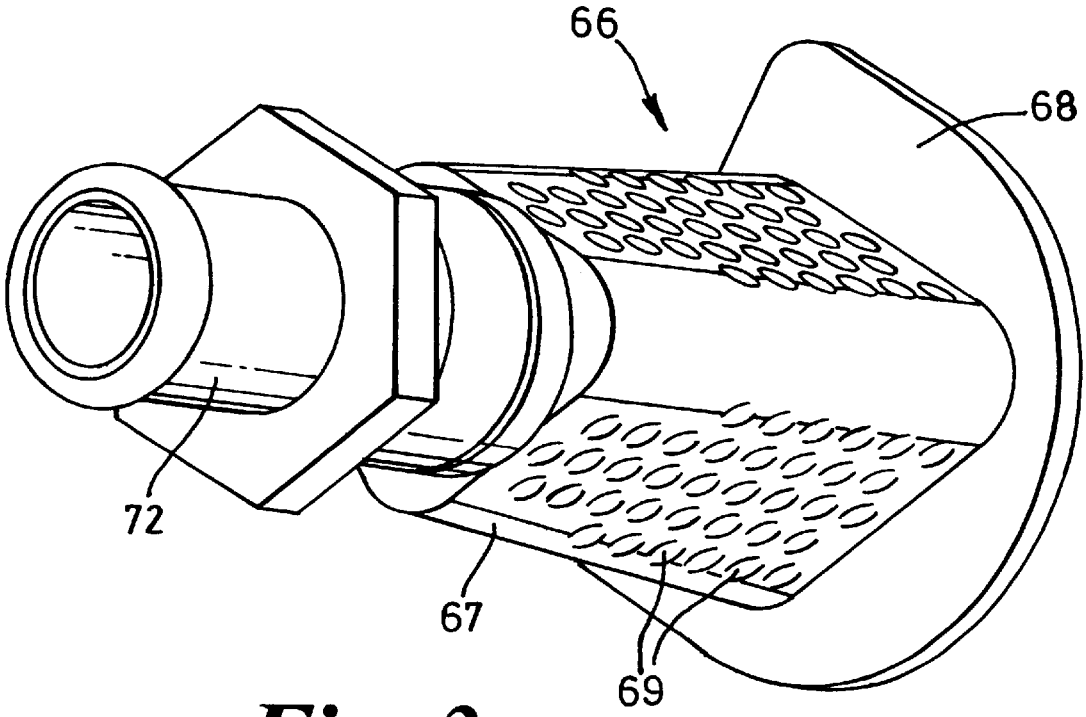
FIG. 3 is an isometric view of the oil deflector apparatus or baffle of FIG. 2 in the form of an assembly of composite mouldings.

A critical feature of the baffle 66 of FIGS. 2 and 3 is a tapering triangular cross-section body 67 affixed at a first (large) end to a 'D'-shaped end-plate 68. it is important that the baffle is positioned in the fuel injection pump housing with a flat side of the triangular body nominally uppermost when the engine is nominally horizontal, though the baffle may be fitted inclined inwardly downward by, for example, 30° from the horizontal where if this is of benefit to the performance or the installation. The 'D'-shaped end-plate 68 serves to positively locate the baffle 66 in the required rotational position and further acts to deflect any masses of oil entering the fuel injection pump housing via the passageway from the timing case.

The body of the baffle is perforated with holes 69 of, in the present example, 3 mm diameter and of a number determined by experimentation or calculation for the engine type to which it is to be fitted. A second end 70 of the body carries an external screw thread and is positioned into the breather gas connection 71 on the fuel injection pump housing from an engine side with the flat of the 'D'-shaped end-plate in engagement with a side of the housing.

An outer connection 72 has a first end 73 carrying an internal screw thread and this first end is positioned into the breather gas connection 71 so as to threadingly engage with the second end of the body. The outer connection is sealed to the fuel injection pump housing with a sealing ring 74. A pipe (20 in FIG. 1F) from fuel injection pump housing to separator is fluidly connected to the outer connection.

The triangular cross-sectional shape of the body of the baffle and its critical rotational position in the fuel injection pump housing as described above are important in ensuring the most effective performance in discouraging oil droplets from being carried over into the breather system. In use, a face of the body is nominally uppermost when the engine is nominally horizontal in order to present the holes in the baffle at an angle to the direction of oil droplets impinging upon the baffle in steep inclinations of the engine. It has also been found that oil collecting on the body tends to run down and drop off under the specified rotational position of the baffle.

When the engine is operated at inclinations of up to 35°, it has been found that the oil-shedding performance of the body of the baffle remains effective if it has been fitted as described above. If the body is rotationally located other than as described, the performance in nominally horizontal engine position is satisfactory but performance decays when the engine is inclined, particularly in the FED inclination.

When the body is provided as a composite (plastic) component, further advantages may be enjoyed. Firstly, a triangular section body can be readily moulded using a three-part die such that the pins on the die for forming the perforations may be in a single plane whereas for a body of round section the pins would need to be set at graduated angles. Further, three sides are the least number possible for a hollow body, therefore economies may be realised in moulding. Further still, the tapering form of the body will ease removal of any mandrel positioned within the body for the moulding process.

Where the body is provided as a composite (plastic) moulding, the corners between the planar surfaces may be left un-perforated for manufacturing convenience.

What is claimed is:

1. A baffle for fitment over breather gas inlet means of an internal combustion engine breather system to limit the ingress of oil droplets comprising a baffle plate disposed at a first end of said baffle, a second end of said baffle connectable to said breather gas inlet means, and a gas conduit extending between said ends being open at the second end and closed at the first end by the baffle plate and having perforated divergent walls such that the cross-sectional area of the conduit increases as the conduit extends from said second end towards said first end.

2. A baffle in accordance with claim 1 wherein the baffle plate is generally planar, and disposed to lie in use in an orientation generally perpendicular to the breather gas flow into the inlet.

3. A baffle in accordance with claim 1 wherein the plate is of such a size as to extend outwardly beyond the perimeter of the conduit at the second end.

4. A baffle in accordance with any preceding claim wherein the baffle plate has a D-shaped end face.

5. A baffle in accordance with claim 1 wherein the baffle comprises a plurality of perforated baffle elements extending between the first and second ends so as to be disposed around a breather gas flow into the inlet in use.

6. A baffle in accordance with claim 5 wherein the baffle elements comprise a plurality of substantially planar perforated baffle faces formed into a conduit by means of intermediate portions.

7. A baffle in accordance with claim 5 provided with three baffle faces, so as to produce a baffle conduit having substantially triangular cross-section.

8. A breather system for an internal combustion engine comprising breather gas inlet means to receive breather gas from within an engine casing, and said breather gas inlet means fluidly connected via breather gas conduit means to a separator capable of separating oil from suspension within the breather gas, and baffle means in accordance with claim 1 fitted in position over the breather gas inlet means to limit the ingress of oil droplets.

9. A system in accordance with claim 8 wherein the breather gas inlet means are disposed to open nominally horizontally with respect to an engine in a nominally horizontal orientation.

10. A system in accordance with claim 9 wherein the baffle comprises a plurality of substantially planar baffle faces formed into a conduit by means of intermediate portions, such that the intermediate portions comprise areas of relatively high curvature and the baffle is fitted onto the breather gas inlet means to be so disposed that an intermediate portion is nominally lowermost with the engine in a horizontal orientation.

11. A system in accordance with claim 10 wherein the baffle comprising three baffle faces and having a substantially triangular cross-section is fitted to the inlet means and is so disposed that a baffle face is nominally uppermost in use with the engine in a nominally horizontal orientation.

12. A system in accordance with claim 8 further comprising a crankcase defining a lower, crankcase volume and a top cover defining an upper volume; breather gas inlet means to receive breather gas from one or more locations within the lower crankcase volume; and breather gas conduit means fluidly connecting said breather gas inlet means to a separator capable of separating oil from suspension within the breather gas.

13. A system in accordance with claim 12 wherein the gas outlet conduit means fluidly connect with, and convey the cleaned gaseous product of, the separator to the engine air intake system.

14. A method for cleaning internal combustion engine crankcase breather gas, which method comprises the fitment of a baffle in accordance with claim 1 to the breather gas inlet of a breather system on an internal combustion engine.

* * * * *

UNITED STATES PATENT AND TRADEMARK OFFICE

CERTIFICATE OF CORRECTION

PATENT NO. : 6,199,543 B1
DATED : March 13, 2001
INVENTOR(S) : Maciej Bedkowski

It is certified that error appears in the above-identified patent and that said Letters Patent is hereby corrected as shown below:

Column 9,
Line 38, delete "any preceding claim" and insert -- claim 1 --.

Signed and Sealed this

Twelfth Day of March, 2002

*Attest:*

*Attesting Officer*

JAMES E. ROGAN
*Director of the United States Patent and Trademark Office*